US009233807B2

(12) United States Patent
Lo et al.

(10) Patent No.: US 9,233,807 B2
(45) Date of Patent: Jan. 12, 2016

(54) APPARATUS FOR ACTUATING A LIFT PLATE OF A MEDIA TRAY

(75) Inventors: Kevin Lo, Vancouver, WA (US); Jerrod Tyler, Vancouver, WA (US); John Pruyn, Portland, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/396,669

(22) PCT Filed: Jun. 26, 2012

(86) PCT No.: PCT/US2012/044192

§ 371 (c)(1), (2), (4) Date: Oct. 23, 2014

(87) PCT Pub. No.: WO2014/003720

PCT Pub. Date: Jan. 3, 2014

(65) Prior Publication Data

US 2015/0084270 A1 Mar. 26, 2015

(51) Int. Cl.

*B65H 1/04* (2006.01)
*B65H 1/14* (2006.01)
(Continued)

(52) U.S. Cl.

CPC .. *B65H 1/14* (2013.01); *B65H 1/04* (2013.01); *B65H 1/08* (2013.01); *B65H 1/12* (2013.01); *B65H 1/266* (2013.01); *B65H 2402/64* (2013.01); *B65H 2403/47* (2013.01); *B65H 2405/11172* (2013.01)

(58) Field of Classification Search

CPC ..... B65H 1/08; B65H 1/14; B65H 1/12; B65H 2405/1115; B65H 2405/11163; B65H 2405/1117; B65H 2405/121; B65H 2405/31; B65H 1/04; B65H 2403/41; B65H 2403/47; B65H 2405/11172; B65H 2402/65; B65H 1/266

USPC ..... 271/147, 157, 160, 162

See application file for complete search history.

(56) References Cited

U.S. PATENT DOCUMENTS 4,227,800 A * 10/1980 Nezu ..... 355/72
4,280,692 A * 7/1981 Hutchinson et al. ..... 271/160

(Continued)

FOREIGN PATENT DOCUMENTS

JP 04-075929 10/1992
JP 2006076731 3/2006

(Continued)

OTHER PUBLICATIONS

International Search Authority, International Search Report mail date Feb. 18, 2013. Application No. PCT/US2012/044192 Filing date Jun. 26, 2012.

*Primary Examiner* — David H Bollinger

(74) *Attorney, Agent, or Firm* — Hewlett-Packard Patent Department

(57) ABSTRACT

An apparatus for actuating a lift plate of a media tray is disclosed herein. An example of the apparatus includes a rocker assembly adjacent the lift plate and a slide assembly coupled to the rocker assembly to actuate the rocker assembly subsequent to insertion of the media tray in a printing device, thereby raising the lift plate. The apparatus additionally includes a lock assembly to release the lock assembly upon initiation of opening of the media tray, thereby allowing the lift plate to lower prior to such removal. A media tray and method for actuating a lift plate of a media tray are also disclosed herein.

13 Claims, 9 Drawing Sheets

(51) Int. Cl.

| | |
|---|---|
| ***B65H 1/26*** | (2006.01) |
| ***B65H 1/08*** | (2006.01) |
| ***B65H 1/12*** | (2006.01) |

(56) References Cited

U.S. PATENT DOCUMENTS

| | | | | |
|---|---|---|---|---|
| 4,728,094 | A | 3/1988 | Yoshida | |
| 5,078,380 | A * | 1/1992 | Kitazawa | 271/9.05 |
| 5,823,525 | A * | 10/1998 | Miki | 271/127 |
| 6,783,126 | B2 | 8/2004 | Amamoto | |
| 6,942,212 | B2 | 9/2005 | Koh | |
| 7,658,375 | B2 | 2/2010 | Wong et al. | |
| 7,722,032 | B2 | 5/2010 | Sasaki et al. | |
| 7,946,572 | B2 | 5/2011 | Sheng et al. | |
| 2003/0201597 | A1 * | 10/2003 | Koh | B65H 1/12 271/147 |
| 2006/0157914 | A1 * | 7/2006 | Suwa | B65H 1/08 271/126 |
| 2007/0200284 | A1 * | 8/2007 | Takahashi | 271/160 |
| 2008/0048384 | A1 * | 2/2008 | Kusama | 271/145 |
| 2010/0097668 | A1 | 4/2010 | Chung | |
| 2011/0140353 | A1 * | 6/2011 | Morinaga | B65H 1/12 271/264 |
| 2011/0227277 | A1 | 9/2011 | Wada et al. | |
| 2014/0103602 | A1 * | 4/2014 | Blair et al. | 271/117 |
| 2015/0076764 | A1 * | 3/2015 | Chiba et al. | 271/253 |

FOREIGN PATENT DOCUMENTS

| | | |
|---|---|---|
| JP | 2011-121722 | 6/2011 |
| JP | 2011-131960 | 7/2011 |

* cited by examiner

APPARATUS FOR ACTUATING A LIFT PLATE OF A MEDIA TRAY

BACKGROUND

Consumers appreciate value in their printing devices. They also appreciate speed in printing devices. Designers and manufacturers may, therefore, endeavor to provide such printing devices to these consumers.

BRIEF DESCRIPTION OF THE DRAWINGS

The following detailed description references the drawings, wherein.

DETAILED DESCRIPTION

Media trays are utilized in printing devices designs to hold sheets of media for selection by a pick assembly of such devices. Media trays may accommodate a range of different medium sizes through the use of length and width adjusters in the media tray that may be moved depending on the particular size of media the consumer desires to use.

Multiple media trays may be used in printing device designs where it is anticipated that more than one size of sheet media (e.g., letter and legal) may typically be used. This saves time for printing device users who would otherwise have to change the media within a tray when desiring to use a different sized media in a printing device having only one media tray.

A lift plate within the media tray is actuated to raise the stack of media in the media tray, after it is inserted into a printing device, so that the media stack is adjacent to a pick assembly of the printing device. This allows the pick assembly of the printing device to select one or more sheets of medium for printing.

The lift plate and adjacent stack of media must be lowered prior to opening of the media tray, otherwise the tray will not open fully and the sheets of medium of the media stack may be damaged and/or jammed within the printing device. Damage to the media tray and other parts of the printing device (e.g., pick assembly) may also occur.

The lift plate and adjacent media stack are typically raised by a single dedicated motor and then lowered by another. Oftentimes, the lift plate and adjacent stack of media are only partially raised or not raised at all before printing in case the media tray needs to be opened, which, if the lift plate were fully raised, would require the motor to rotate in the opposite direction to lower it before an end user could open the media tray. This takes time and could potentially cause damage of the type described above, should the end user force open the tray before the lift plate and adjacent media stack were fully lowered. Upon initiation of printing, the lift plate and adjacent media stack are raised to a position adjacent the pick assembly for selection of one or more sheets thereby.

The use of a single dedicated motor (one direction to raise the lift plate and the other to lower it) adds to the overall cost of a printing device. It can also increase the size of a power supply that provides energy to the dedicated motor. This larger power supply also adds to the cost of a printing device, not to mention the likely increase in size and weight of the printing device.

Figure 1:
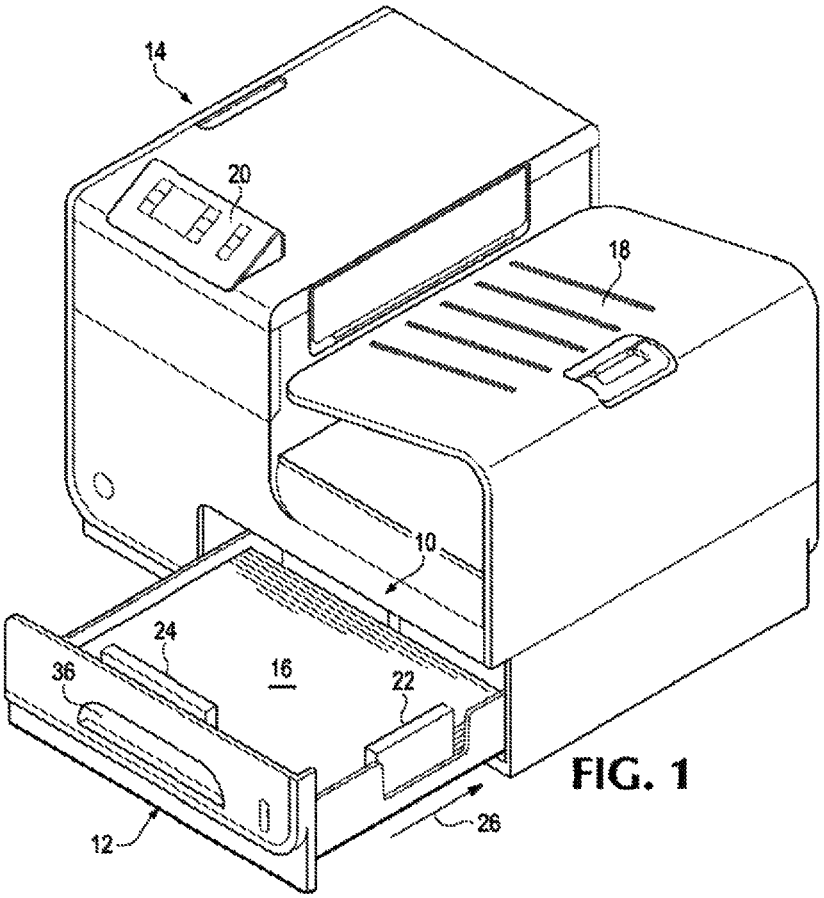
FIG. 1 is an illustration of a printing device that includes an example of an apparatus for actuating a lift plate of a media tray.

An apparatus 10 for actuating a lift plate of a media tray 12 for use in a printing device 14 directed to addressing these issues is shown in FIG. 1. Apparatus 10 and media tray 12 require only one motor direction to raise a lift plate, thereby saving the added cost associated with a single dedicated motor, as discussed above. No motor move is required to lower the lift plate and adjacent media stack prior to opening of media tray 12. This allows the other direction of rotation of the single motor to be used for other tasks, such as media picking and/or servicing of ink jet print heads. Additionally, as discussed more fully below, apparatus 10 and media tray 12 initially raise the lift plate and stack of media to a position adjacent the pick assembly of printing device 14 saving time by allowing printing to more quickly begin on selected sheets of medium, which increases printing device throughput.

Furthermore, the lift plate and adjacent media stack are quickly lowered by the influence of gravity upon initiation of opening of media tray 12 by an end-user of printing device 14. This helps avoid the issues associated with premature opening of media tray 12, as also discussed above.

As used herein, the terms "non-transitory storage medium" and non-transitory computer-readable storage medium" are defined as including, but not necessarily being limited to, any media that can contain, store, or maintain programs, information, and data. Non-transitory storage medium and non-transitory computer-readable storage medium may include any one of many physical media such as, for example, electronic, magnetic, optical, electromagnetic, or semiconductor media. More specific examples of suitable non-transitory storage medium and non-transitory computer-readable storage medium include, but are not limited to, a magnetic computer diskette such as floppy diskettes or hard drives, magnetic tape, a random access memory (RAM), a read-only memory (ROM), an erasable programmable read-only memory (EPROM), a flash drive, a compact disc (CD), or a digital video disk (DVD).

As used herein, the term "processor" is defined as including, but not necessarily being limited to, an instruction execution system such as a computer/processor based system, an Application Specific Integrated Circuit (ASIC), or a hardware and/or software system that can fetch or obtain the logic from a non-transitory storage medium or a non-transitory computer-readable storage medium and execute the instructions contained therein. "Processor" can also include any controller, state-machine, microprocessor, clod-based utility, service or feature, or any other analogue, digital and/or mechanical implementation thereof.

As used herein "printing device" is defined as including, but not necessarily being limited to, a printer that uses any of the following marking technologies or a combination thereof: ink jet, laser jet, dye sublimation, liquid toner, off-set printing, impact, or dot matrix. As used herein, "media" is defined as including, but not necessarily being limited to any type of paper or other printing medium (e.g., cloth, canvas, transparency, etc.), having any type of finish on either or both sides (e.g., glossy, matte, plain, textured, etc.), in any size, shape, color, or form (e.g., sheet, roll (cut or uncut), folded, etc.).

Referring again to FIG. 1, media tray 12 holds sheets of media 16 in a stack for selection and transport by media handling system of printing device 14 from media tray 12, past a print zone (not shown) to output tray or shelf 18, where printed media is collected for retrieval by one or more end users. A user interface 20 provides information (e.g., print job status, supplies status, etc.) to one or more end users of printing device 14, as well as allowing such end users to enter information (e.g., user ID, print job ID, etc.) relating to their use of printing device 14.

As can be seen in FIG. 1, media tray 12 is in an open position allowing access to media stack 16 which, for example, can allow replenishment of sheets of media 16 or replacement with a different size and/or type of media. A length adjuster 22 and a width adjuster 24 are movable to accommodate any such differently sized media. Media tray 12 may be closed or inserted into printing device 14 by moving it in the direction of arrow 26.

Figure 2:
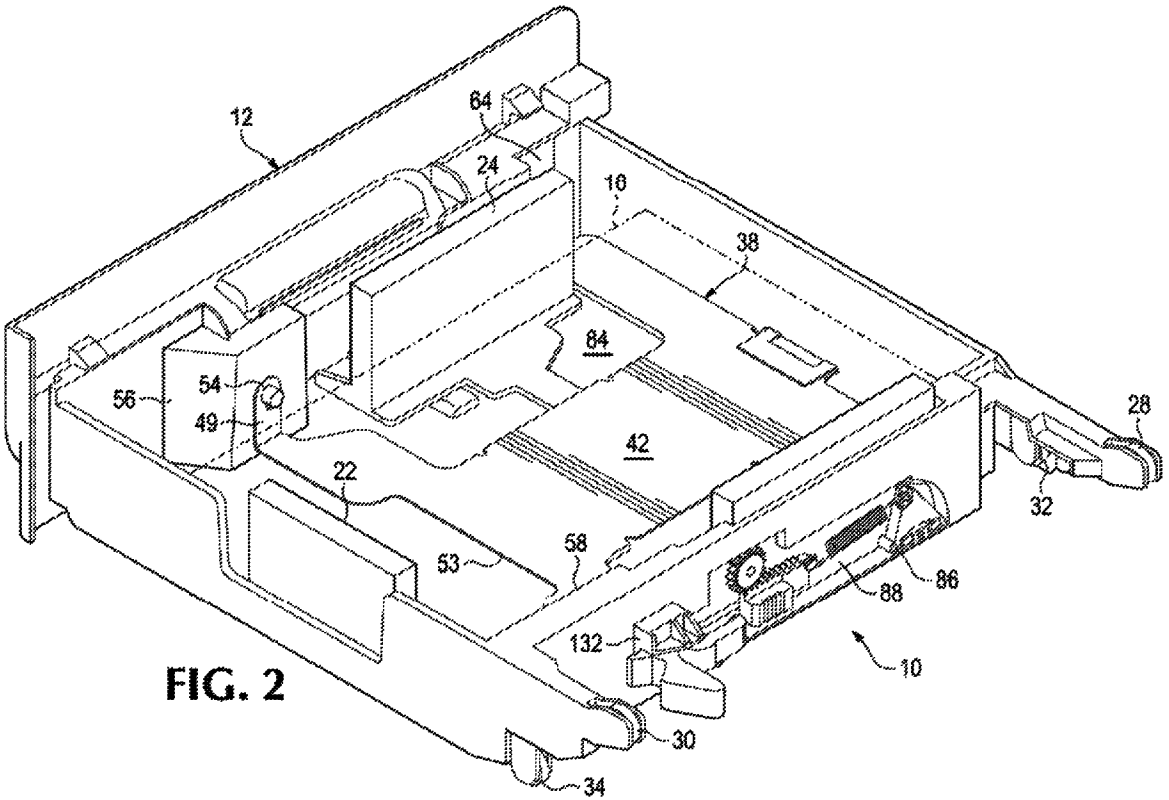
FIG. 2 is an illustration of an example of a media tray and apparatus for actuating a lift plate of the media tray.

An example of apparatus 10 and media tray 12 removed from printing device 14 are shown in FIG. 2. As can be seen in FIG. 2, media tray 12 includes pairs of rollers 28 and 30 and pairs of rollers 32 and 34 that ride in or on tracks (not shown) of printing device 14. Rollers 28, 30, 32, and 34 in combination with these tracks allow media tray 12 to be opened and closed by end users via handle 36 (see FIG. 1). As can also be seen in FIG. 2, media tray 12 includes a lift plate assembly 38 below and adjacent to stack of media sheets 16 shown in phantom via dotted lines in FIG. 2.

Figure 3:
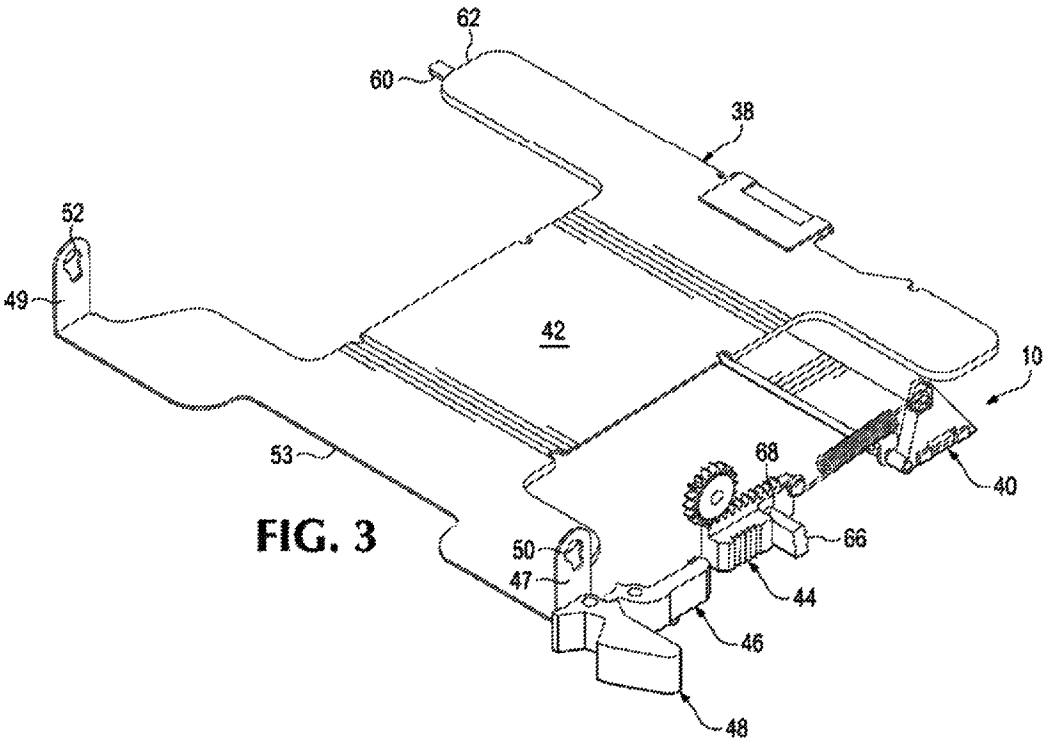
FIG. 3 is an illustration of an example of the apparatus for actuating the lift plate of the media tray of FIG. 2 with the lift plate in a lowered position.
Figure 4:
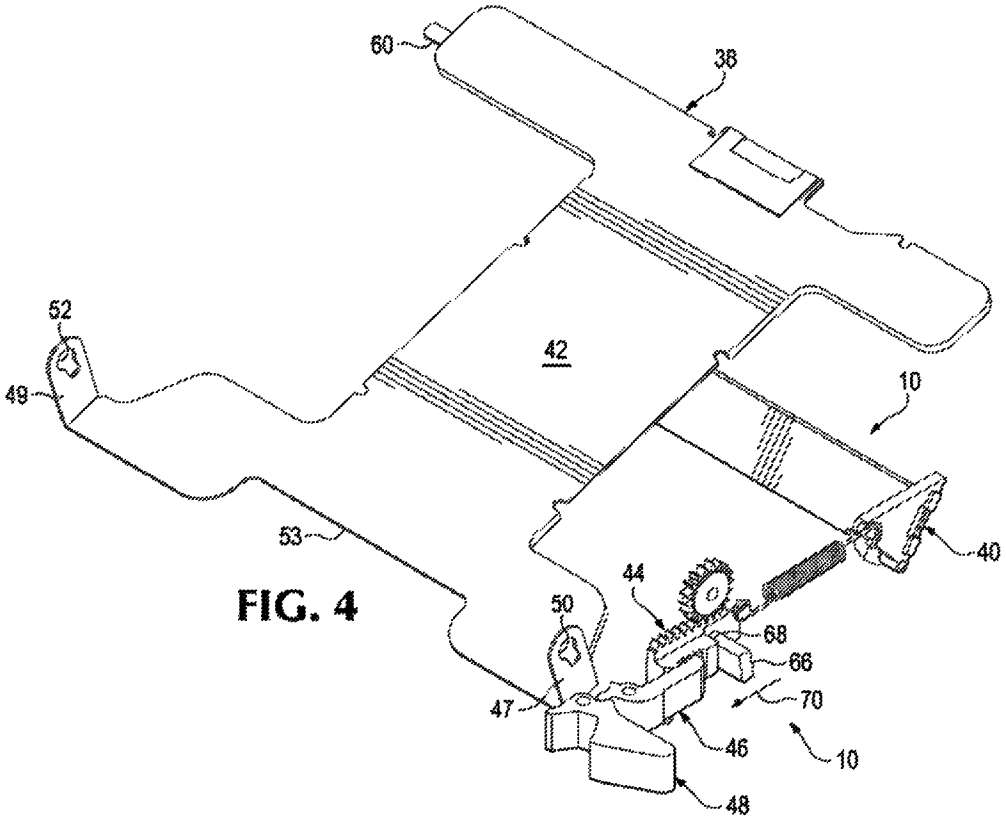
FIG. 4 is an illustration of an example of the apparatus for actuating the lift plate of the media tray of FIG. 2 with the lift plate in a raised position.

An example of apparatus 10 for actuating lift plate assembly 38 is shown in FIG. 3. As can be seen in FIG. 3, lift plate assembly 38 is shown in lowered position, as in FIG. 2, which permits media tray 12 to be opened and/or removed from printing device 12 (see FIG. 1). Referring again to FIG. 3, it can be seen that apparatus 10 includes a rocker assembly 40 adjacent lift plate 42 and a slide assembly 44 coupled to rocker assembly 40 to actuate rocker assembly 40 subsequent to closing or insertion of media tray 12 in printing device 14 thereby raising lift plate 42, as shown in FIG. 4. Apparatus 10 additionally includes a lock assembly 46 to secure slide assembly 44 and a latch assembly 48 coupled to lock assembly 46 to release lock assembly 46 upon initiation of opening of media tray 12, thereby allowing lift plate 42 to lower prior to such removal, as discussed more fully below.

As can be seen in FIGS. 3 and 4, lift plate assembly 38 includes a pair of upstanding members 47 and 49 each of which defines a respective aperture or opening 50 and 52. A fastener is positioned within each of openings 50 and 52 and connected to media tray 12 to secure end 53 of lift plate 42 to media tray 12 while still allowing the remainder of lift plate 42 to be raised and lowered by apparatus 10. One such fastener 54 is shown disposed within opening 52 of upstanding member 49 into wall 56 of media tray 12 in FIG. 2. As shown, for example in FIG. 9, a similar fastener 55 is disposed within opening 50 of upstanding member 47 into wall 58 of media tray 12.

As can additionally be seen in FIGS. 3 and 4, lift plate assembly 38 also includes a tab 60 that extends from side 62 of lift plate 42. Tab 60 abuts wall 64 of media tray 12 (see FIG. 2) to help provide lateral stability to lift plate 42 during raising and lowering by apparatus 10. As can further be seen in FIGS. 3 and 4, a member or pin 66 of printing device 14 abuts side 68 of slide assembly 44. Pin or member 66 is driven by a gear assembly and motor (not shown) of printing device 14 in the direction of arrow 70 in FIG. 4 to raise lift plate 42 from the lowered position shown in FIG. 3 to the raised position shown in FIG. 4. This gear assembly and motor are in turn controlled by a processor executing instructions on a non-transitory storage medium of printing device 14, neither of which are shown.

Figure 5:
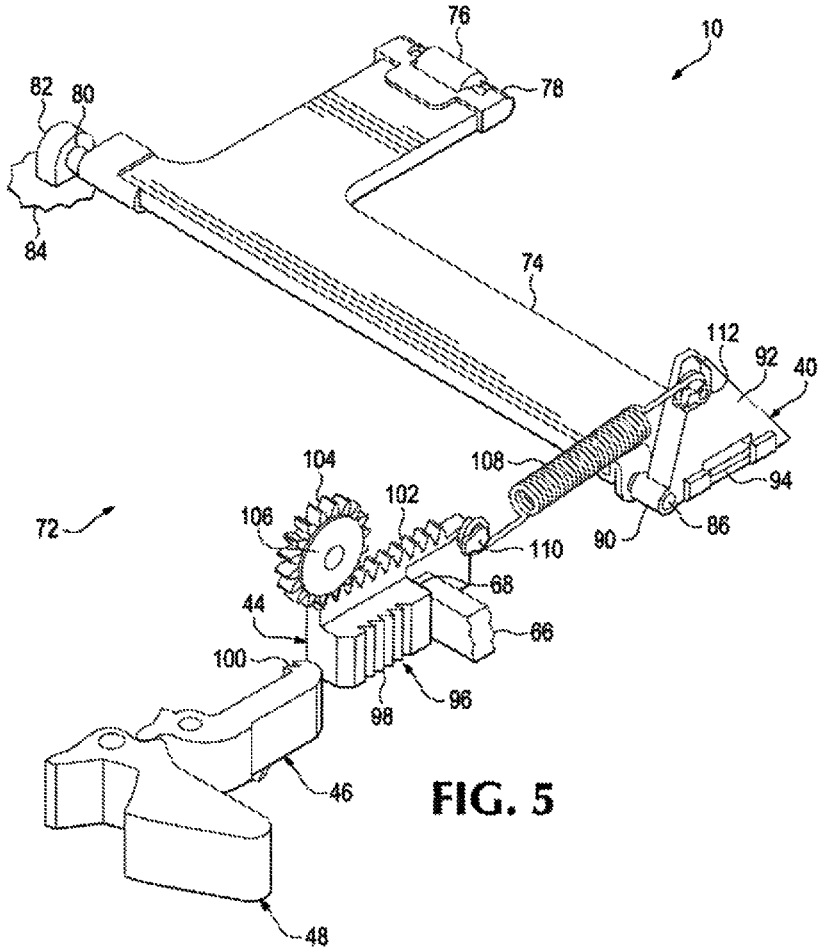
FIG. 5 is an illustration of an example of an actuation assembly in an unlocked and lowered position.

An illustration of an example of an actuation assembly 72 of apparatus 10 in an unlocked and lowered position is shown in FIG. 5. As can be seen in FIG. 5, rocker assembly 40 includes a generally "L"-shaped plate 74 having a roller 76 rotatably mounted on end 78. Plate 74 also includes a pin 80 rotatably positioned in an opening of upstanding member 82 which is connected to floor 84 (see FIG. 2) of media tray 12. Plate 74 additionally includes a pin 86 rotatably positioned through an opening (not shown) in wall 88 (see FIG. 2) of media tray 12 an in opening on corner 90 of triangular member 92, as shown. In this manner, rocker assembly 40 of actuation assembly 72 of apparatus 10 is coupled to media tray 12. Plate 74 is connected to bottom or side 94 of triangular member 92.

Figure 6:
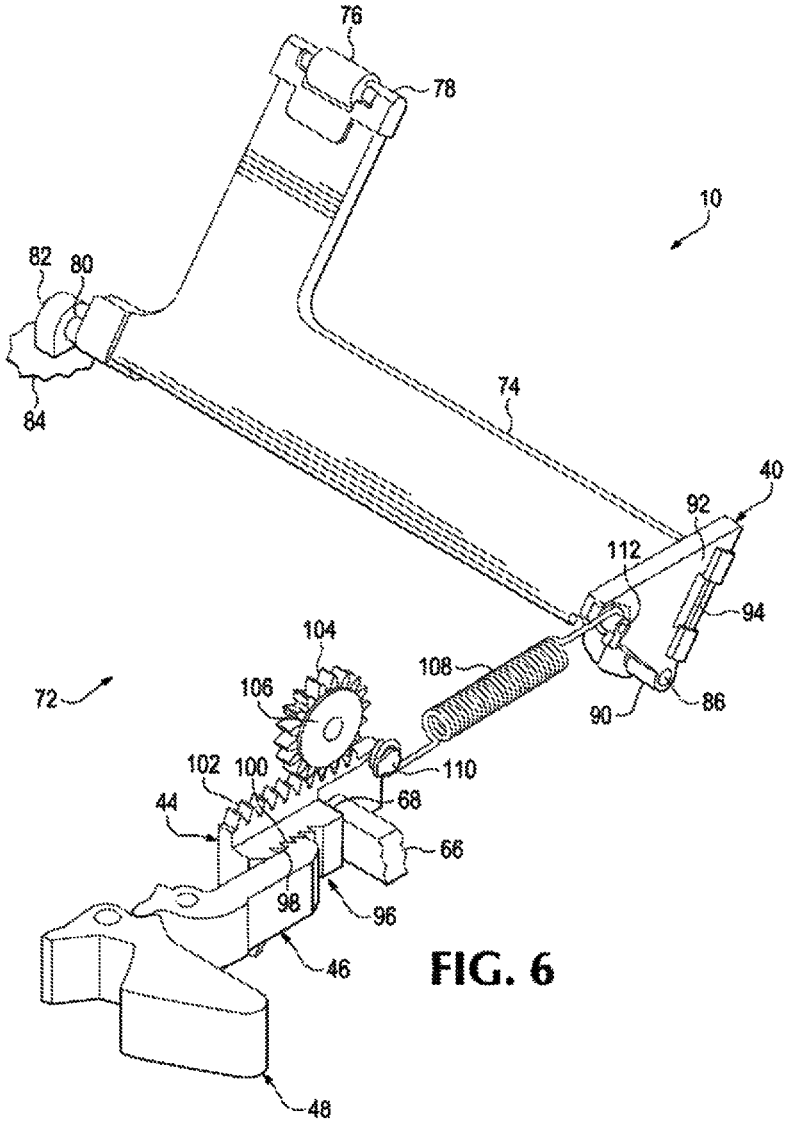
FIG. 6 is an illustration of an example of an actuation assembly in a locked and raised position.

As can also be seen in FIG. 5, slide assembly 44 includes a ratchet mechanism 96 having a first set of teeth 98 that engage with a second set of teeth 100 of lock assembly 46, as shown, for example, in FIG. 6, to secure rocker assembly 40 in the position shown, which in turn raises and secures lift plate 42 in the raised position. Ratchet mechanism 96 includes a third set of teeth 102 that mesh with teeth 104 of gear 106. Gear 106 is damping gear that helps keep lift plate 42 from lowering too rapidly so as to create an annoying audible clang.

As can further be seen in FIGS. 5 and 6, slide assembly 44 additionally includes a biasing member 108 connected on one end 110 to ratchet mechanism 96 and on another end 112 to triangular member 92 of rocket assembly 40. Biasing member 108 provides a range of deflection for rocker assembly 40 and thus lift plate 42. This is accomplished through selection of an expansion constant that tensions biasing member 108 through a predetermined range when loaded by, for example, a pick roller 114 (see FIG. 8) of a pick assembly against media stack 16 for selection of one or more sheets of print medium for printing by printing device 14.

Figure 7:
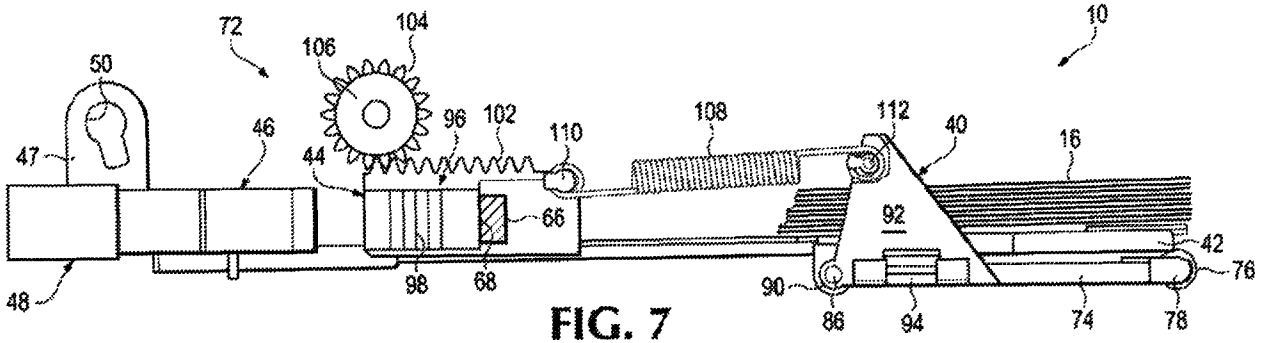
FIG. 7 is an illustration of a side view of an example of an apparatus for actuating a lift plate and adjacent media stack in an unlocked and lowered position.
Figure 8:
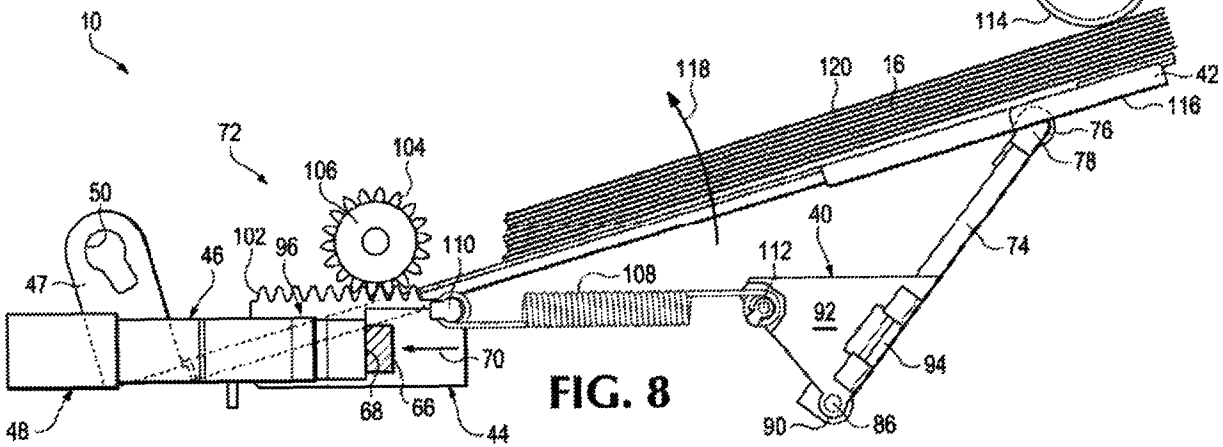
FIG. 8 is an illustration of a side view of the example of the apparatus for actuating the lift plate and adjacent media stack in a raised and locked position.

An illustration of a side view of an example of apparatus 10 for actuating lift plate 42 and adjacent media stack 16 in an unlocked and lowered position is shown in FIG. 7. An illustration of a side view of the example of apparatus 10 for actuating the lift plate 42 and adjacent media stack 16 to a raised and locked position is shown in FIG. 8. As can be seen by comparing FIGS. 7 and 8, member or pin 66 has been moved by the gear assembly and motor (neither of which are shown) in the direction of arrow 70 which causes triangular member 92 of rocker assembly 40 to rotate about pins 80 and 86 which raises L-shaped plate 74 from the position shown in FIG. 7 to the position shown in FIG. 8. This in turn causes roller 76 on end 78 of plate 74 to rotate and push against bottom 116 of lift plate 42 raising it in the direction indicated by arrow 118 until top sheet of medium 120 is against pick roller 114 for selection thereby. Look assembly 46 secures lift plate 42 in this position through engagement of first set of teeth 98 with second set of teeth 100, as discussed above in connection with FIG. 6.

Lift plate 42 remains in this raised position adjacent pick roller 114 until initiation of opening of media tray 12, as discussed more fully below. This provides the advantage of allowing pick roller 114 to select top sheet of medium 120 without the delay of first having to raise lift plate 42. The non-transitory storage medium of printing device 14 has additional instructions that cause the processor of printing device 14 to actuate the motor and gear assembly of printing device 14 (none of which are shown) to move pin or member 66 in the direction of arrow 70 in cases where pick roller 114 fails to select top sheet of medium 120. This further raises lift plate 42 and media stack 16 in the direction of arrow 118 thereby increasing a normal force exerted by lift plate 42 on media stack 16 adjacent pick roller 114 which increases the likelihood of a successful selection of top sheet of medium 120 by the pick assembly of printing device 14.

Figure 9:
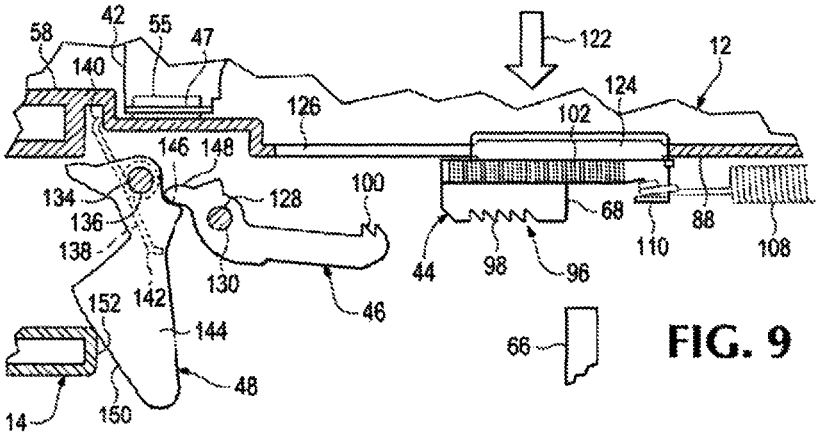
FIG. 9 is an illustration of a partial top view of an example of closing or insertion of the media tray of FIG. 2 into the printing device of FIG. 1.

An illustration of a partial top view of an example of closing or insertion of media tray 12 into printing device 14 in the direction of arrow 122 is shown in FIG. 9. As can be seen in FIG. 9, ratchet mechanism 96 includes an overhanging portion or member 124 that rides along a track 126 formed in wall portion 88 of media tray 12. As can also be seen in FIG. 9, lock assembly 46 defines an opening 128 through which a shaft or pin 130 is disposed to pivotally connect lock assembly 46 to overhanging portion 132 (see FIG. 2) of media tray 12. Referring again to FIG. 9, latch assembly 48 also defines an opening 134 through which a shaft or pin 136 is also disposed to pivotally connect latch assembly 48 to overhanging portion 132. Latch assembly 48 additionally includes a biasing member 138 that extends around shaft or pin 136 and includes a first end 140 positioned against wall 58 and a second end 142 positioned underneath arm 144 of latch assembly 48.

As can additionally be seen in FIG. 9, arm 144 of latch assembly 48 includes a notch 146 in which a finger or member 148 of lock assembly 46 is disposed. This arrangement allows latch assembly 48 to move lock assembly 46. As can further be seen in FIG. 9, arm 144 includes a camed-surface 150 that interacts with a wall or chassis 152 of printing device 14 during closing or insertion of media tray 12 therein.

Figure 10:
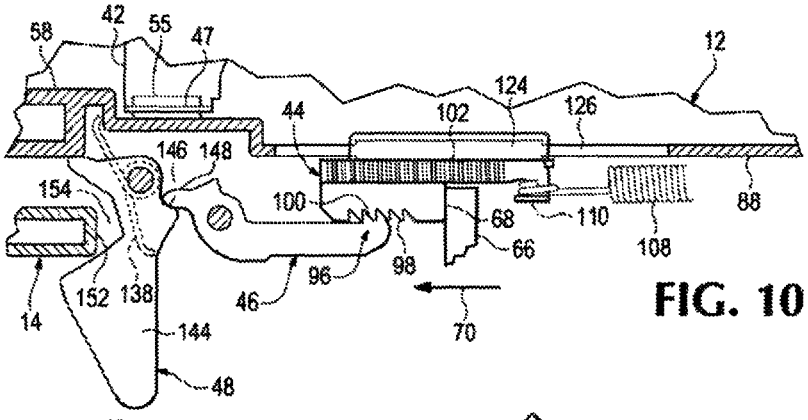
FIG. 10 is an illustration of a partial top view of the media tray of FIG. 9 upon insertion in the printing device and raising of the lift plate by the actuation assembly.

An illustration of a partial top view of media tray 12 upon insertion in printing device 14 and raising of lift plate 42 by actuation assembly 72 of apparatus 10 is shown in FIG. 10. As can be seen in FIG. 10, printer wall or chassis 152 now resides in a recess 154 of arm 144 and pin or member 66 of printing device 14 has moved in the direction of arrow 70 to raise lift plate 42, as discussed above. As can also be seen in FIG. 10, biasing member 138 of latch assembly 48 is urging teeth 100 of lock assembly 46 against teeth 98 of ratchet mechanism 96, via engagement between notch 146 and finger or member 148, to secure slide assembly 44 and thus lift plate 42 in the raised position. As can additionally be seen in FIG. 10, teeth 98 of ratchet mechanism 96 and teeth 100 of lock assembly 46 are angled in a direction that permits them to slide against and past one another in the direction generally indicated by arrow 70, but that also inhibits them from doing so in a direction generally opposite that indicated by arrow 70.

Figure 11:
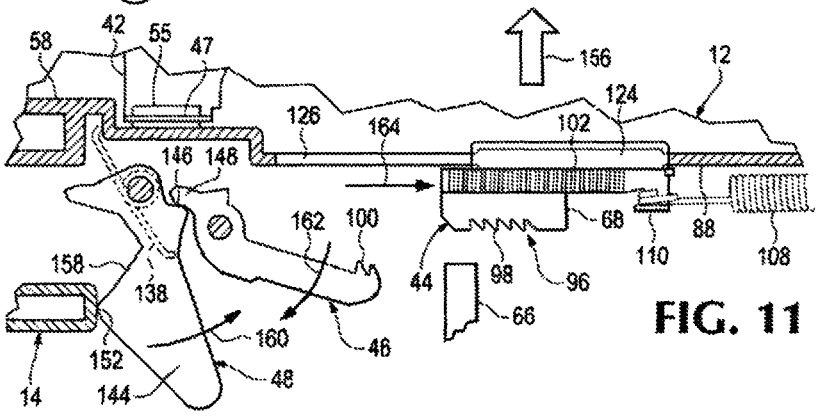
FIG. 11 is an illustration of a partial top view of an example of the initiation of opening or removal of the media tray of FIG. 10 and lowering of the lift plate via the actuation assembly.

An illustration of a partial top view of an example of the initiation of opening or removal of media tray 12 in the direction of arrow 156 and lowering of lift plate 42 via the actuation assembly 72 of apparatus 10 is shown in FIG. 11. As can be seen in FIG. 11, arm 144 includes a camed-surface 158 that interacts with wall or chassis 152 of printing device 14 during initiation of opening or removal of media tray 12. This interaction overcomes the urging of biasing member 138 causing arm 144 of latch assembly 48 to deflect or move in a direction generally indicated by arrow 160 which, by interaction of notch 146 and finger 148, in turn causes lock assembly 46 to move or deflect in a direction generally indicated by arrow 162, thereby disengaging teeth 100 from teeth 98 of ratchet mechanism 96. Slide assembly 44 in turn moves in the direction of arrow 164 as lift plate 42 of lift plate assembly 38 and adjacent media slack 16 lower in an unaided manner under the influence of gravity prior to complete or full opening or removal of media tray 12.

This lowering of lift plate 42 of lift plate assembly 38 occurs without the use of a second motor which avoids the issues associated therewith, as discussed above. Additionally, the lowering occurs in a rapid manner that helps to avoid damage to media 16, media tray 12 and/or printing device 14, as well as associated jams which most be cleared by an end-user.

Figure 12:
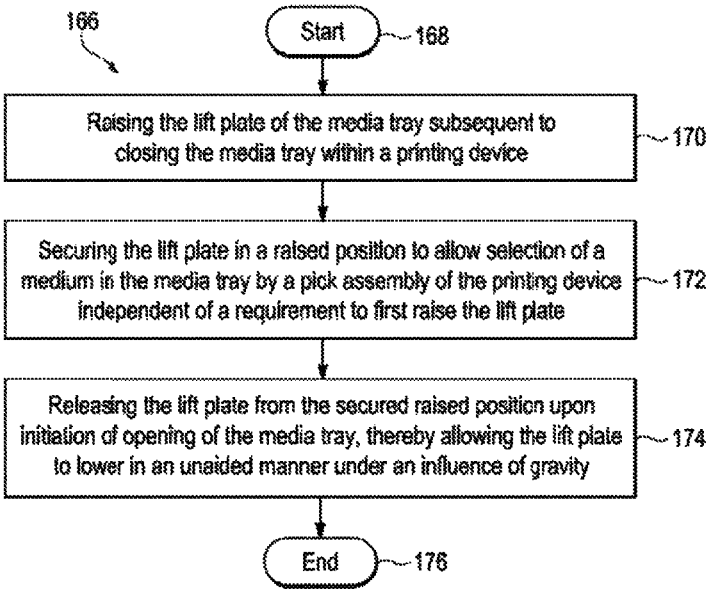
FIG. 12 is an example of a method for actuating a lift plate of a media tray.

An example of a method 166 for actuating a lift plate of a media tray is shown in FIG. 12. As can be seen in FIG. 12, method 166 starts 168 by raising the lift plate of the media tray subsequent to closing the media tray within a printing device, as indicated by block 170. Method 100 continues by securing the lift plate in a raised position to allow selection of a medium is the media tray by a pick assembly of the printing device independent of a requirement to first raise the lift plate, as indicated by block 172, and subsequently releasing the lift plate from the secured raised position upon initiation of opening of the media tray, thereby allowing the lift plate to lower in an unaided manner under an influence of gravity, as indicated by block 174. Method 166 may then end 176.

Figure 13:
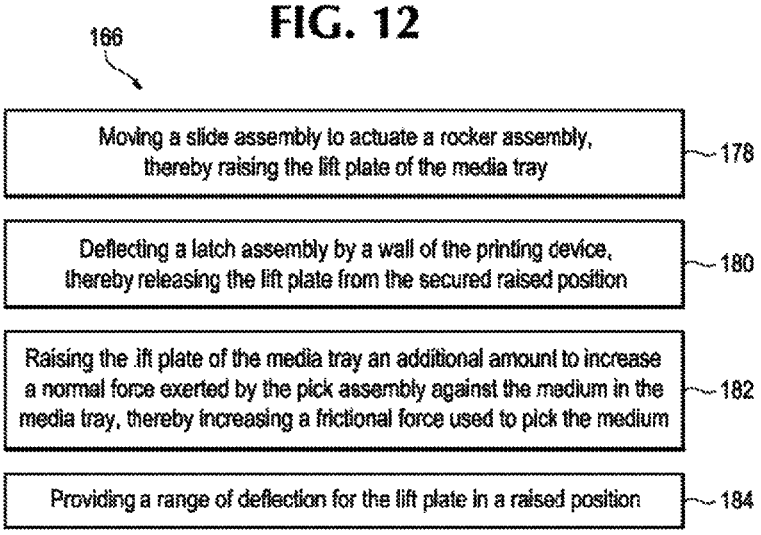
FIG. 13 is an example of additional elements of the method for actuating a lift plate of a media tray.

An example of additional elements of a method 166 for actuating a lift plate of a media tray are illustrated in FIG. 13. As can be seen in FIG. 13, method 166 may additionally include moving a slide assembly to actuate a rocker assembly, thereby raising the lift plate of the media tray, as indicated by block 178. Method 166 may additionally or alternatively include deflecting a latch assembly by a wall of the printing device, thereby releasing the lift plate from the secured raised position, as indicated by block 180. Method 166 may also or alternative include increasing a normal force exerted by the lift plate on media adjacent the pick assembly, as indicated by block 182, and/or providing a range of deflection for the lift plate in a raised position, as indicated by block 184.

Although several examples have been described and illustrated in detail, it is to be clearly understood that the same are intended by way of illustration and example only. These examples are not intended to be exhaustive or to limit the invention to the precise form or to the exemplary embodiments disclosed. Modifications and variations may well be apparent to those of ordinary skill in the art. The spirit and scope of the present invention are to be limited only by the terms of the following claims.

Additionally, reference to an element in the singular is not intended to mean one and only one, unless explicitly so stated, but rather means one or more. Moreover, no element or component is intended to be dedicated to the public regardless of whether the element or component is explicitly recited in the following claims.

What is claimed is:

1. An apparatus for actuating a lift plate of a media tray, comprising:

a rocker assembly adjacent the lift plate;

a slide assembly coupled to the rocker assembly to actuate the rocker assembly subsequent to insertion of the media tray in a printing device, thereby raising the lift plate, wherein the slide assembly includes a ratchet mechanism;

a lock assembly to secure the slide assembly; and a latch assembly coupled to the lock assembly to release the lock assembly upon initiation of opening of the media tray, thereby allowing the lift plate to lower prior to such removal.

2. The apparatus of claim 1, wherein the slide assembly includes a biasing member to provide a range of deflection of the lift plate.

3. The apparatus of claim 1, wherein the lift plate remains raised until initiation of opening of the media tray from the printing device, thereby allowing a pick assembly of the printing device to operate without waiting for the lift plate to raise.

4. The apparatus of claim 1, wherein the rocker assembly, slide assembly, lock assembly, and latch assembly are coupled to the media tray.

5. The apparatus of claim 1, further comprising a printing device.

6. The apparatus of claim 1, wherein the latch assembly includes a camed-surface that interacts with a chassis of the printing device upon initiation of opening of the media tray from the printing device to release the lock assembly.

7. A media tray, comprising:

a lift plate assembly to raise and lower media in the media tray; and an actuation assembly to raise the lift plate assembly subsequent to closing of the media tray within a printing device, to maintain the lift plate assembly in the raised position while the media tray remains closed within the printing device, and to release the lift plate assembly upon initiation of opening of the media tray, thereby allowing the lift plate assembly to lower in an unaided manner under an influence of gravity prior to complete opening of the media tray, wherein the actuation assembly includes a camed-surface that interacts with a chassis of the printing device to release the lift plate assembly.

8. The media tray of claim 7, wherein the actuation assembly includes a rocker assembly.

9. The media tray of claim 8, wherein the actuation assembly includes a slide assembly coupled to the rocker assembly.

10. The media tray of claim 9, wherein the actuation assembly includes a lock assembly to secure the slide assembly, and further wherein the actuation assembly includes a latch assembly to release the lock assembly.

11. The media tray of claim 7, wherein the actuation assembly includes a biasing member to allow the lift plate assembly to deflect through an arc of movement.

12. The media tray of claim 7, further comprising a printing device.

13. The media tray of claim 7, wherein the actuation assembly can increase a normal force exerted by the lift plate assembly on media adjacent a pick assembly of the printing device.

* * * * *